US006865986B2

(12) United States Patent
Link

(10) Patent No.: US 6,865,986 B2
(45) Date of Patent: Mar. 15, 2005

(54) DEVICE AND METHOD FOR CLEANING A PRINTING CARRIER BEFORE EACH PRINTING CYCLE

(75) Inventor: Robert Link, München (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 10/451,284

(22) PCT Filed: Nov. 6, 2001

(86) PCT No.: PCT/EP01/12828

§ 371 (c)(1),
(2), (4) Date: Nov. 17, 2003

(87) PCT Pub. No.: WO02/49843

PCT Pub. Date: Jun. 27, 2002

(65) Prior Publication Data

US 2004/0089179 A1 May 13, 2004

(30) Foreign Application Priority Data

Dec. 21, 2000 (DE) ..... 100 63 987

(51) Int. Cl.[7] ..... B41L 41/00
(52) U.S. Cl. ..... 101/424; 101/425; 101/483
(58) Field of Search ..... 101/425, 424, 101/483

(56) References Cited

U.S. PATENT DOCUMENTS

| | | | |
|---|---|---|---|
| 3,800,699 | A | 4/1974 | Carley |
| 5,067,404 | A | 11/1991 | Frunder et al. |

FOREIGN PATENT DOCUMENTS

| | | |
|---|---|---|
| DE | 27 18 522 | 11/1977 |
| DE | 39 07 366 | 9/1990 |
| DE | 39 11 932 | 7/1992 |
| DE | 44 17 784 | 11/1995 |
| DE | 43 42 954 | 1/1996 |
| DE | 197 32 060 | 1/1999 |
| DE | 197 50 242 | 5/1999 |
| DE | 197 50 243 | 5/1999 |
| EP | 0 755 788 | 1/1997 |
| WO | WO 97/36746 | 10/1997 |
| WO | WO 98/32608 | 7/1998 |
| WO | WO 01/02170 | 1/2001 |
| WO | WO 01/02171 | 1/2001 |

*Primary Examiner*—Andrew H. Hirshfeld
*Assistant Examiner*—Marissa Ferguson
(74) *Attorney, Agent, or Firm*—Schiff Hardin LLP

(57) ABSTRACT

For cleaning a printing medium, the printing medium for each print cycle is structured on its surface such that it carries new image information that is inked with ink material. Inked material is transfer printed on a medium. The surface of the printing medium is cleaned before application of a new image information by charging with a cleaning fluid.

22 Claims, 3 Drawing Sheets

DEVICE AND METHOD FOR CLEANING A PRINTING CARRIER BEFORE EACH PRINTING CYCLE

BACKGROUND OF THE INVENTION

The invention relates to a device to clean a printing medium, in that the printing medium is structured such that it carries new image information for each print cycle that is inked with ink material that is printed upon a medium, for example paper or an intermediate carrier. Furthermore, the invention concerns a method to clean a print medium.

Printing methods in which the printing medium is newly structured by a digital method for each print cycle are known from WO 98/32608, WO 97/36746, and U.S. Pat. No. 5,067,404 from the same applicant. For example, the surface of the printing medium is structured in WO 98/32608 such that ink-attracting and ink-repelling regions exist. A substance present in the solid phase, preferably water, is used as an ink-repelling medium generated thereon by cooling the surface of the printing medium. After the ink material is transfer printed to the paper, the surface of the printing medium is cleaned of ink residue. The printing medium is then structured anew and carries new image information. A digital method is used in the structuring, for example using the radiation of a laser, a laser diode, an LED or an LED array. In a method according to WO 97/36746, a thin moisture film is generated every print cycle on the surface of the printing medium by charging the surface with water vapor, and subsequently the structuring of the moisture film is undertaken. The aforementioned documents are herewith included by reference in the disclosure of the present patent application.

Further methods and printing devices to print a medium material and to clean a print roller are known from the PCT patent applications with serial numbers PCT/EP00/06028 and PCT/EP00/06026 by the same applicant. A plurality of depressions are present on the surface of a printing medium for the acceptance of printing fluid. Ink material is placed in these depressions with the aid of an inking station. The printing fluid contained in the depressions is used to print on a printing medium at a transfer printing location. With the aid of a digital method, every print cycle the print fluid in the depressions is dealt with in such a manner that a portion of the print fluid is transfer printed at the transfer printing location, and another portion remains in the depressions. Both of these cited documents are also herewith included by reference in the disclosure of the present patent application.

It is necessary in the cited printing methods that, before applying new image information to the surface of the printing medium, this surface is cleaned of ink residues and other substances. The cleaning process must be of such a nature that it can be included in the printing process without problems, in particular upon consideration of the structuring of the surface of the printing medium with the aid of a digital method. As a result, the cleaning duration must be short, and a large number of cleaning cycles should be possible for the same cleaning medium.

The prior art is further referenced in U.S. Pat. No. 5,067,494 as well as in document DE-A-19 750 242, as given in the preamble.

SUMMARY OF THE INVENTION

An object of the invention is to specify a device and a method to clean a printing medium that can be included in a simple manner in the printing process and that work with a short cleaning duration.

According to the present invention, for cleaning a printing medium, the printing medium for each print cycle is structured on its surface such that it carries new image information that is inked with ink material. Inked material is transfer printed on a medium. The surface of the printing medium is cleaned before application of a new image information. The surface of the image medium is charged with a cleaning fluid.

Exemplary embodiments are explained in the following with drawings.

DESCRIPTION OF THE PREFERRED EMBODIMENT

Figure 1:
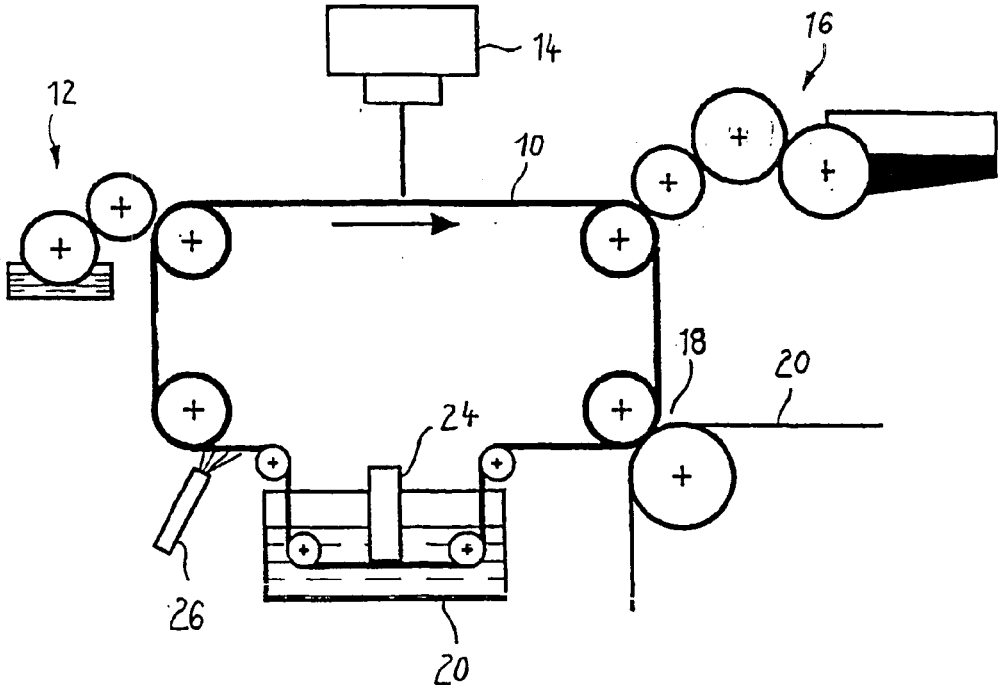
FIG. 1 is a schematic of a printing process with a band-shaped printing medium that is fed through an immersion bath with cleaning fluid.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

The cleaning fluid is preferably comprised of water; if need be, cleaning additives are present. An intermediate carrier can be present as well as a printing medium upon which the image information from a first printing medium is transferred. A cleaning device can be arranged at both a first printing medium and at an intermediate carrier. These measures make the overall printing process environmentally friendly and economical.

FIG. 1 shows the basic design of a printer that structures the surface of a band-shaped printing medium 10 with the aid of a digital method. The band-shaped printing medium 10 is fed over a plurality of deflection rollers that are not individually referenced. An application station 12 applies a fluid film to the surface of the print medium. For example, this can occur as is described in the already cited U.S. Pat. No. 5,067,404 by the same applicant.

The surface of the printer medium 10 is structured with the aid of a structuring device 14 such that it carries new image information. For example, a structuring occurs such that ink-attracting and ink-repelling regions are generated with the aid of a laser beam according to a digital method. An ink application device 16 inks ink-attracting regions with ink material. The ink material is transfer printed at a transfer printing location 18 onto a medium 20, for example paper or an intermediate carrier. The band-shaped printing medium 10 is subsequently fed over deflection rollers and arrives in an immersion bath 22 with cleaning fluid. The cleaning fluid is comprised of water. The cleaning fluid is preferably comprised exclusively of water; if need be, cleaning additives are supplied. An ultrasonic actuator 24 charges the band-shaped printing medium 10 with ultrasonic energy, by means of which the separation of ink particles is accelerated. The ultrasonic actuator 24 can be arranged on both sides of the printing medium 10.

The cleaned printing medium is dried following the immersion bath 22, for example by a fan 26 and/or by a radiation source (not shown). The surface of the printing medium is then ready to be charged with a new moisture film by the application device 12. The print cycle can begin anew.

Figure 2:
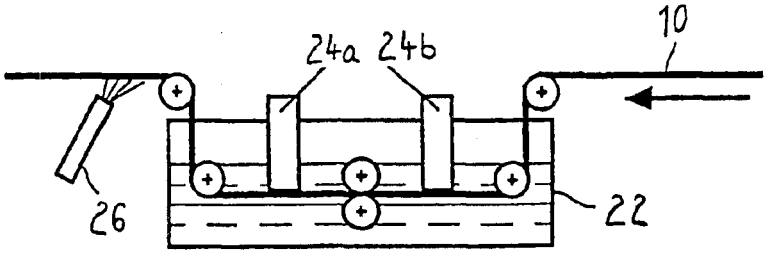
FIG. 2 is a similar arrangement as FIG. 1, with a multiple-stage ultrasonic charging of the band-shaped printing medium.

FIG. 2 shows a variant, wherein the band-shaped printing medium 10 undergoes a multi-stage cleaning in the immersion bath 22. Two ultrasonic actuators 24*a*, 24*b* are present, by means of which the cleaning effect is increased. In this case as well, each ultrasonic actuator 24*a*, 24*b* can act upon the back side (as shown) or upon the front side of the printing medium 10.

Figure 3:
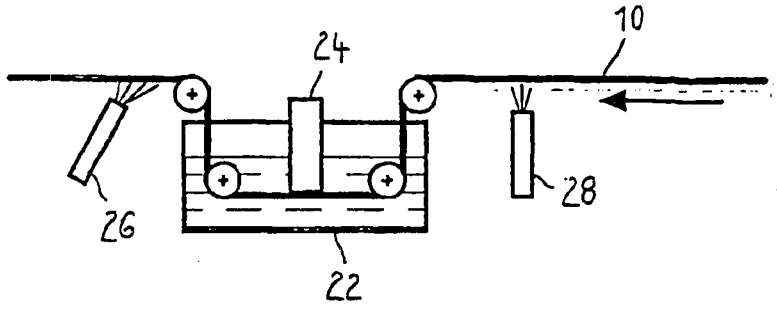
FIG. 3 is a combination of high pressure cleaning and immersion bath for a band-shaped printing medium.

FIG. 3 shows a further variant, wherein a high-pressure cleaning device 28 is arranged that sprays a cleaning fluid under high pressure onto the surface of the band-shaped printing medium 10. A preliminary cleaning occurs in this manner. The subsequent final cleaning is undertaken in the immersion bath 22 under the effect of the ultrasonic actuator 24.

Figure 4:
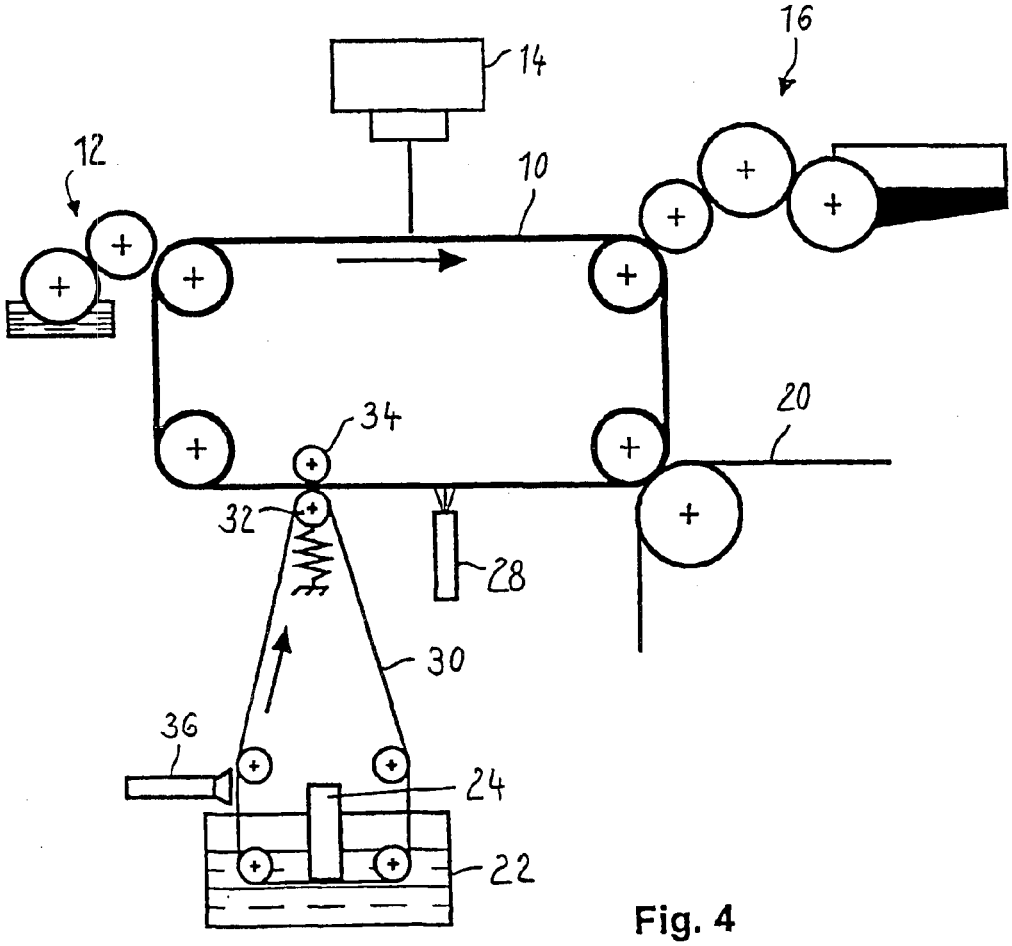
FIG. 4 is a design of a cleaning device with cleaning belt.

FIG. 4 shows a variant of the exemplary embodiment according to FIG. 1. Identical parts are identically designated. The band-shaped printing medium 10 does not itself traverse the immersion bath 22. Rather, a cleaning belt 30 is provided that is brought in contact with the band-shaped printing medium 10. With the aid of a spring-loaded pressure roller 32, the cleaning belt 30 presses against the printing medium 10 that in turn presses against a counter-pressure roller 34. The cleaning belt 30 is implemented as a conveyer belt or as a woven belt and provides for the removal of the ink particles.

The cleaning belt 30 is fed through the immersion bath 22 and is charged with ultrasonic energy from the ultrasonic actuator 24. After traversing the immersion bath 22, the cleaning band 30 is conducted past a suction device 36 which sucks off cleaning fluid. The cleaning by the cleaning belt 30 is preceded by the high-pressure cleaning device 28, with whose aid the ink residue is loosened from the printing medium.

Figure 5:
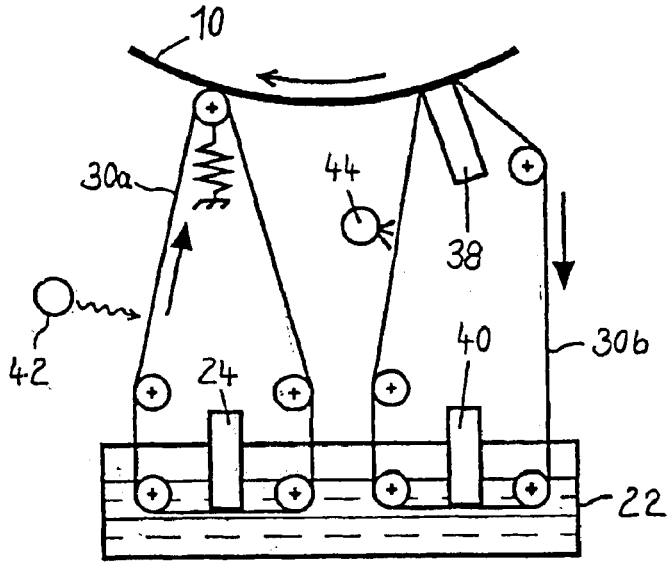
FIG. 5 is a multi-stage cleaning process with two cleaning belt.

FIG. 5 shows a multi-stage cleaning with the aid of two cleaning belts 30*a*, 30*b*. A drum is used here as the printing medium 10. The cleaning belt 30*b* effects a preliminary cleaning with the involvement of two ultrasonic actuators 38, 40. The ultrasonic actuator 38 acts on the printing medium 10. The ultrasonic actuator 40 acts on the cleaning belt 30*b* in the immersion bath 22. An application of cleaning fluid, for example water, occurs by agency of the water application device 44 before the cleaning belt 30*b* contacts the printing medium 10. The cleaning belt 30*a* is cleaned by use of the ultrasonic actuator 24. A heat source 42 dries the cleaning band 30*a* and charges its surface with heat energy. Both cleaning bands 30*a*, 30*b* rotate counter to the running direction of the printing medium 10.

Figure 6:
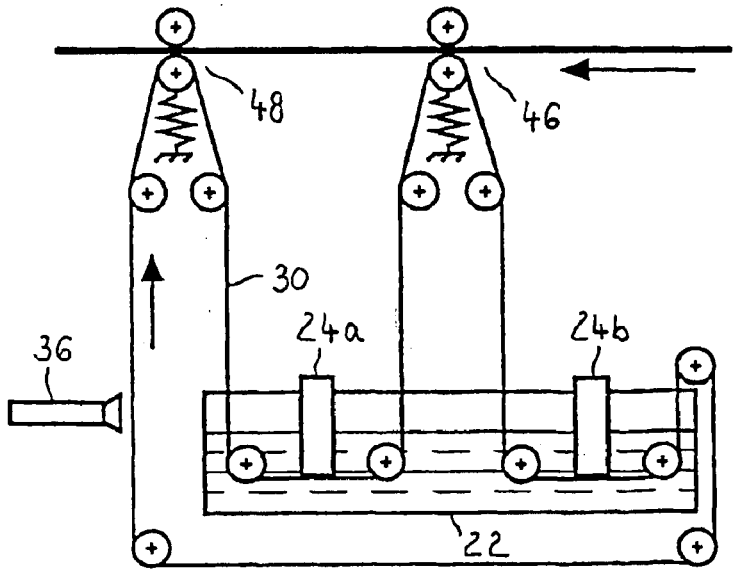
FIG. 6 is a multi-stage cleaning process with a single endless cleaning belt.

FIG. 6 shows a further variant, wherein a single cleaning belt carries out the multi-stage cleaning. The cleaning belt 30 effects a preliminary cleaning at a first cleaning location 46 and a final cleaning at a second cleaning position 48.

The exemplary embodiments presented can be modified in many ways. For example, a rigid cleaning roller, whose surface comprises a tiled covering a woven covering, or bristles, can be used instead of a cleaning belt. Cleaning fluid can be removed from the coating of the cleaning barrel or the cleaning belt with the aid of pinch rollers. Alternatively, wiper elements and stripping elements can be used. The polluted cleaning fluid can be separated from the dirt particles with appropriate methods (for example filter methods, separation methods making use of centrifugal force or gravitational force) and newly supplied to the immersion bath in a recycling cycle.

In a further variant it is provided that, for example in the exemplary embodiments according to FIGS. 4, 5, and 6, the cleaning belt can be held a distance from the medium, such that no cleaning occurs. The image structure thus remains on the cleaning belt. The same image pattern can be newly transfer printed, given a new application of ink. The print cycle then comprises a plurality of transfer printing events. The print cycle then comprises a plurality of transfer printing procedures. If a new print cycle with a new image pattern is begun, the cleaning belt must again be brought in contact with the printing medium beforehand in order to clean its surface. A new image pattern can then be applied.

The specified cleaning devices can preferably be used in connection with a printing process as is specified in WO 97/36746. In this, hydrophobic and hydrophilic regions corresponding to the structure of the print image to be printed are generated on the surface of the printing medium. The surface is overlaid with a thin liquid film that moistens the hydrophilic regions. Ink is subsequently applied to the surface that adheres to the unmoistened regions and is not accepted by the moistened regions. The ink is transfer printed from there onto the medium material. The surface is charged with water vapor to generate the thin liquid film. The water vapor can preferably be transferred onto the surface by agency of a vaporization device arranged near the surface of the printing medium. The water vapor can also be generated by agency of a moistened fabric tape arranged near the surface of the printing medium that is heated with the aid of a radiation source and/or a heat source, whereby the water vapor is transferred onto the surface.

The specified cleaning device can also be advantageously used in connection with a printing method specified in WO 98/32608. In this printing method, ink-attracting and ink-repelling regions corresponding to the structure of the printing image to be printed are generated on the surface of the printing medium. The ink-repelling regions are provided with a film made of an ink-repelling medium. Upon application of ink to the surface, it adheres to the ink-attracting regions; the ink is not accepted by the ink-repelling regions. The ink thus distributed on the surface of the printing medium according to the printing image is transfer printed to a medium material. A substance is used as an ink-repelling medium in the affixing phase that is generated on the surface if the printing medium by cooling. To generate the solid phase of the substance, preferably water, the printing medium is preferably cooled, at least on its surface, to a temperature below the solidification temperature of the substance. The print-active surface of the printing medium is next completely provided with a sold state layer, preferably an ice layer. In a digital structuring process, regions free of solids or, respectively, ice, are generated as ink-attracting regions corresponding to the structure of the printing image to be printing. A refrigerant system is preferably used to cool the printing medium. The ice layer of the surface of the printing medium is charged by radiation to form the ice-free regions, for example with the radiation of a laser, a laser diode, an LED, or an LED array. The ice-free regions can alternatively be generated by use of a heating element.

A further preferred possible field of application of the specified cleaning device can be used for printing methods that are specified in the PCT patent applications with serial numbers PCT/EP00/06028 and PCT/EP00/06026. The surface of the printing drums hereby has a plurality of depressions for the acceptance of printing fluid. An inking station delivers printing fluid to these depressions. With the aid of a digital structuring process, the surface tension of the printing fluid in the depressions is influenced corresponding to an image pattern to be printed. The printing fluid from the depressions corresponding to the image pattern is printed on the medium during the transfer printing. The printing fluid remains in the other depressions and is not applied to the medium. The specified cleaning devices are suitable to completely strip the printing fluid from the depressions, such that a complete cleaning of the surface of the printing medium is enabled. The latter are then ready to accept new printing fluid in the depressions, and a new structuring process and transfer printing process can occur.

Further details of the specified printing method are found in the cited documents, whose contents hereby referenced are included in the contents of the disclosure of the present patent application.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

What is claimed is:

1. A method for cleaning a printing medium, comprising the steps of:

structuring the printing medium for each print cycle on its surface such that it carries new image information that is inked with ink material;

transfer printing the ink material on a medium; and cleaning the surface of the printing medium before application of a new image information by charging the surface of the printing medium with a cleaning fluid, the cleaning occurring in a plurality of cleaning stages.

2. A method for cleaning a printing medium, comprising the steps of:

structuring the printing medium for each print cycle on its surface such that it carries new image information that is inked with ink material;

transfer printing the ink material on a medium; and cleaning the surface of the printing medium before application of a new image information by charging the surface of the printing medium with a cleaning fluid, the surface of the printing medium being at least brought in contact with a cleaning belt in order to clean it, and the cleaning belt and the surface of the printing medium being charged with ultrasonic energy.

3. A method for cleaning a printing medium, comprising the steps of:

structuring the printing medium for each print cycle on its surface such that it carries new image information that is inked with ink material;

transfer printing the ink material on a medium; and cleaning the surface of the printing medium before application of a new image information by charging the surface of the printing medium with a cleaning fluid, the surface of the printing medium being at least brought in contact with a cleaning belt in order to clean it, and the cleaning belt being directed to a suction device after traversing an immersion bath with the cleaning fluid.

4. A method for cleaning a printing medium, comprising the steps of:

structuring the printing medium for each print cycle on its surface such that it carries new image information that is inked with ink material;

transfer printing the ink material on a medium; and cleaning the surface of the printing medium before application of a new image information by charging the surface of the printing medium with a cleaning fluid, the surface of the printing medium being at least brought in contact with a cleaning belt in order to clean it, and the cleaning belt being moved counter to a running direction of the printing medium.

5. A method for cleaning a printing medium, comprising the steps of:

structuring the printing medium for each print cycle on its surface such that it carries new image information that is inked with ink material;

transfer printing the ink material on a medium; and cleaning the surface of the printing medium before application of a new image information by charging the surface of the printing medium with a cleaning fluid, the surface of the printing medium being at least brought in contact with a cleaning belt in order to clean it, and the cleaning belt being directed to a heat source after traversing an immersion bath.

6. A method for cleaning a printing medium, comprising the steps of:

structuring the printing medium for each print cycle on its surface such that it carries new image information that is inked with ink material;

transfer printing the ink material on a medium; and cleaning the surface of the printing medium before application of a new image information by charging the surface of the printing medium with a cleaning fluid, and the cleaning having multi-stages, whereby a first cleaning belt effects a preliminary cleaning and a second subsequent cleaning belt undertakes an end cleaning.

7. A method for cleaning a printing medium, comprising the steps of:

structuring the printing medium for each print cycle on its surface such that it carries new image information that is inked with ink material;

transfer printing the ink material on a medium; and cleaning the surface of the printing medium before application of a new image information by charging the surface of the printing medium with a cleaning fluid, the surface of the printing medium being at least brought in contact with a cleaning belt in order to clean it, and a single endless cleaning belt effecting a multi-stage cleaning.

8. A method for cleaning a printing medium, comprising the steps of:

structuring the printing medium for each print cycle on its surface such that it carries new image information that is inked with ink material;

transfer printing the ink material on a medium; and cleaning the surface of the printing medium before application of a new image information by charging the surface of the printing medium with a cleaning fluid, the surface of the printing medium being brought in contact with a cleaning belt being moved to a running direction of the printing medium, and the cleaning occurring in a plurality of cleaning stages.

9. The method according to claim 8 wherein the structuring of the surface of the printing medium occurs with aid of a digital method.

10. The method according to claim 8 wherein the cleaning fluid is comprised of water.

11. The method according to claim 8 wherein the cleaning fluid is comprised of water and cleaning additives.

12. The method according to claim 8 wherein the surface of the printing medium is charged with a high-pressure emission of cleaning fluid.

13. The method according to claim 8 wherein the printing medium is band-shaped and is led through an immersion bath with the cleaning fluid.

14. The method according to claim 8 wherein the cleaning belt is pressed against the surface of the printing medium with the aid of a spring resistance.

15. The method according to claim 14 wherein the band-shaped printing medium is applied to a counter-pressure roller.

16. The method according to claim 8 wherein the cleaning belt is charged with ultrasonic energy.

17. The method according to claim 8 wherein the cleaning belt is moved counter to a running direction of the printing medium.

18. The method according to claim 8 wherein the cleaning belt is directed to a water application device after traversing an immersion bath.

19. The method according to claim 8 wherein the cleaning belt comprises one of a conveyor belt and a fabric tape.

20. The method according to claim 8 wherein a cleaning roller is brought in contact with the printing medium.

21. The method according to claim 8 wherein the surface of the printing medium is optionally brought in contact with at least one of a cleaning belt and a cleaning roller.

22. The method according to claim 8 wherein the printing medium is an intermediate carrier upon which the image information is transfer printed from a first printing medium.

* * * * *